US005588941A

United States Patent [19]

Scott

[11] Patent Number: 5,588,941

[45] Date of Patent: Dec. 31, 1996

[54] SPINE THERAPHY AND EXERCISE DEVICE

[76] Inventor: Gary L. Scott, 331 Indian Hills Circle, Clinton, Anderson County, Tenn. 37716

[21] Appl. No.: 445,691

[22] Filed: May 22, 1995

[51] Int. Cl.[6] ..... A63B 21/00

[52] U.S. Cl. ..... 482/131; 482/43; 482/907; 482/139

[58] Field of Search ..... 482/121, 122, 482/124, 907, 139, 43, 131, 114

[56] References Cited

U.S. PATENT DOCUMENTS

| | | | |
|---|---|---|---|
| 2,280,274 | 4/1942 | Wildermuth . | |
| 4,456,249 | 6/1984 | Calabrese . | |
| 4,588,186 | 5/1986 | Claabrese . | |
| 4,909,505 | 3/1990 | Tee | 482/121 |
| 5,207,627 | 5/1993 | Doran | 482/124 |
| 5,258,017 | 11/1993 | Meyers . | |
| 5,328,433 | 7/1994 | Berman | 482/124 |

*Primary Examiner*—Lynne A. Reichard
*Attorney, Agent, or Firm*—Pitts & Brittian, P.C.

[57] ABSTRACT

A spine therapy and exercise device (10) for conditioning and exercising the muscles associated with the back, abdomen and legs. The device (10) of the present invention includes a belt member (12) and a harness (14). The harness (14) is carried by the belt member (12) and is provided for receiving the arms of the wearer. The harness (14) of the preferred embodiment is fabricated from a pair of straps (16), each being secured at one end (18) to the belt member (12), crossing each other to form an "X" configuration, and are then being releasably secured to the belt member (12) at their distal ends (20). Adjustment members (26) are provided on each strap (16) for adjusting the size of the harness (14) to the particular wearer by varying the length of the particular strap (16). The belt member (12) includes a torso engagement portion (28), and a leg engagement portion (34) connected in an end-to-end fashion such as to form a continuous loop. At least the proximal end (30) of the torso engagement portion (28) and the distal end (38) of the leg engagement portion (34) are releasably secured to each other. An adjustment member (42) is also provided for varying the length of the loop for various sizes of users, for various types of exercises, and for various resistances during a given exercise. An elastomeric member (44) is provided at each end (30,32) of the torso engagement portion (28), with the leg engagement portion (34) being secured at its ends (36,38) to the elastomeric members (44). A cushion member (52) is received upon the leg engagement portion (34) such that it may slide along the length thereof to adjust for various users and various exercises.

19 Claims, 4 Drawing Sheets

SPINE THERAPHY AND EXERCISE DEVICE

TECHNICAL FIELD

This invention relates to the field of spine therapy. Specifically, the present invention relates to a device for performing spine therapy, including passive and/or active exercise of the spine to loosen and/or strengthen muscles and muscle groups associated with the spine.

BACKGROUND ART

It is well known that many people have mild to serious back injuries due to a lack of physical conditioning, injuries, or a previous medical condition. Specifically, back disorders are caused by one or a combination of: poor posture, use of improper body mechanics, stress, lack of proper exercise, and poor health. Tight muscles and ligaments are prone to tear or strain with minimal physical exertion. As a person ages, the cumulative effects of these and other factors create an ever increasing risk of back injury. However, with proper exercise and conditioning, it is well known that the risk of such injury can be reduced, if not eliminated altogether. Gradual stretching and positioning of the spine to relieve pain and realign the individual vertebrae.

The problem associated with conditioning and strengthening the back is cyclical. Specifically, when pain occurs, movement of the back is difficult. Therefore, to reduce the pain, movement is reduced. As a result of reducing movement, the back muscles stiffen and become weak. This then results in further back problems and greater pain.

The spinal column is supported by a number of muscles. In order to best protect the spine, it is imperative that these muscles be maintained. Damage to the back muscles creates inflammation, pain and, in some cases, spasms. Again, strengthening and toning of the back muscles is preventative treatment for these conditions.

It is well known that the spine includes two basic joints: discs between vertebrae, and articular facets. The articular facets are lined with cartilage and are used to align the vertebrae. As the body is maneuvered, these joints must be able to move in relation to each other, or slide. A failure of two joints to slide results in joint rigidity and back pain. In order to slide, the joints must be properly lubricated by membranes that line the joints. In order to distribute lubricants over the area of the joint, range-of-motion exercises have been found to be highly effective. Such exercises involve bending and relaxing selected joints, such as the knees and hips.

In order to overcome the problems of back pain, and in order to lubricate the, joints comprising the spine, several devices and methods have been developed. One known therapy is yoga, which requires full range-of-motion stretches. Other devices typical of the art are those disclosed in the following U.S. Patents:

| U.S. Pat. Nos. | Inventor(s) | Issue Date |
|---|---|---|
| 2,280,274 | H. E. Wildermuth | Apr. 21, 1942 |
| 4,456,249 | J. Calabrese | June 26, 1984 |
| 4,588,186 | J. Calabrese | May 13, 1986 |
| 5,258,017 | H. Meyers, et al. | Nov. 2, 1993 |

Of these devices, the '274 device disclosed by Wildermuth is provided for manipulating and massaging the spinal column. The '274 device is use, d specifically for correcting misplaced vertebrae and massaging the back in a self-operated manner. The '274 device does not provide a means whereby the back is stretched for aligning the vertebrae. The vertebrae are aligned as a result of engagement with a pad carried on a massaging member.

Those devices disclosed by Calabrese ('249 and '186) and Meyers, et al. ('017) are each provided for stretching exercises for relieving back pain. Each of these devices is provided with at least one stirrup for being engaged by one or both of a user's feet, and a device for being secured about a selected portion of the user's body.

The securement device disclosed by Calabrese in the former patent, '249, is a strap for being placed behind the wearer's neck. Calabrese's latter patent, '186, discloses a harness for being worn over a wearer's shoulders and fastened around the torso proximate the mid-chest region. The stirrup of each of these devices is engaged by one or both feet and is connected to the securement device via a static rope. The free ends of the rope are provided with handles such that they may be gripped by the wearer. The wearer then stretches by pulling on the ropes, thus creating tension between the arms and the legs. By applying pressure to the neck ('249) or to the mid-chest region ('186) further damage can be caused to the condition of the spine.

The securement device disclosed be Myers, et at., is a belt secured about the wearer's waist. Two stirrups are provided such that each foot is received within one each of the stirrups. The stirrups are fabricated from webbing material and define loops at the extents thereof in order to receive a person's foot. Exercise is performed by extending the knees.

In neither of these devices is there provided a means for actively exercising back muscles for stretching and conditioning. Although Calabrese discloses a method for varying the distance from the stirrups to the securement devices, such are inadequate for exercising the legs with respect to the back.

Therefore, it is an object of this invention to provide a device for passively and actively stretching and conditioning muscles surrounding a person's spine.

Another object of the present invention is to provide a means whereby the device is easily and safely secured to and removable from the person's body.

A further object of the present invention is to provide a means whereby the device is adjustable to fit various people, and whereby various exercises may be performed using various resistance levels.

DISCLOSURE OF THE INVENTION

Other objects and advantages will be accomplished by the present invention which is provided for conditioning and exercising the muscles associated with the spine. Moreover, the device of the present invention is designed to provide various levels of resistive exercise to the back, abdomen and legs, and further for providing passive exercise for stretching the back, abdomen and legs. The device of the present invention is comprised generally of a belt member and a harness. The harness is carried by the belt and is provided for receiving the arms of the wearer. The harness of the preferred embodiment is fabricated from a pair of straps, each being secured at one end to the belt member, crossing each other to form an "X" configuration, and are then being releasably secured to the belt member at their distal ends. Thus, a pair of loops are formed for receiving the arms of the user such that the straps are carried over the user's shoulders, the straps cross on the user's back, and the belt circumvents the back and sides of the upper torso. Adjustment members are provided on each strap for adjusting the size of the harness to the particular wearer. Each adjustment member is provided for varying the length of the particular strap.

The belt member includes generally a torso engagement portion, and a leg engagement portion connected in an end-to-end fashion such as to form a continuous loop. In order to aid in the use of the device, at least the proximal end of the torso engagement portion and the distal end of the leg engagement portion are releasably secured to each other using a connecting member such as a conventional quick-disconnect member. An adjustment member is also provided for varying the length of the loop for various sizes of users, for various types of exercises, and for various resistances during a given exercise. The adjustment member is integrally formed with the connecting member. The distal end of the leg engagement portion is inserted through the adjustment member such that it is a free end. Thus, it may be pulled to shorten the loop, or the leg engagement portion may be oppositely pulled to lengthen the loop.

An elastomeric member is provided at each end of the torso engagement portion, with the leg engagement portion being secured at its ends to the elastomeric members such that the loop configuration is maintained. In an embodiment wherein no elastomeric members are incorporated, the torso and leg engagement portions of the belt may be integrally formed. The elastomeric members may be fabricated from an elastic material secured in a loop configuration about two links, or alternatively, comprised of a rubber strap or elastic material secured at either end.

A cushion member is slidably received upon the leg engagement portion such that it may slide along the length thereof to adjust for various users and various exercises.

BRIEF DESCRIPTION OF THE DRAWINGS

The above mentioned features of the invention will become more dearly understood from the following detailed description of the invention read together with the drawings in which.

BEST MODE THE FOR CARRYING OUT THE INVENTION

A spine therapy and exercise device incorporating various features of the present invention is illustrated generally at 10 in the figures. The spine therapy and exercise device, or device 10, is designed for conditioning and exercising the muscles associated with the spine. Moreover, in the preferred embodiment the device 10 is designed to provide various levels of resistive exercise to the back, abdomen and legs, and further for providing passive exercise for stretching the back, abdomen and legs.

Figure 2:
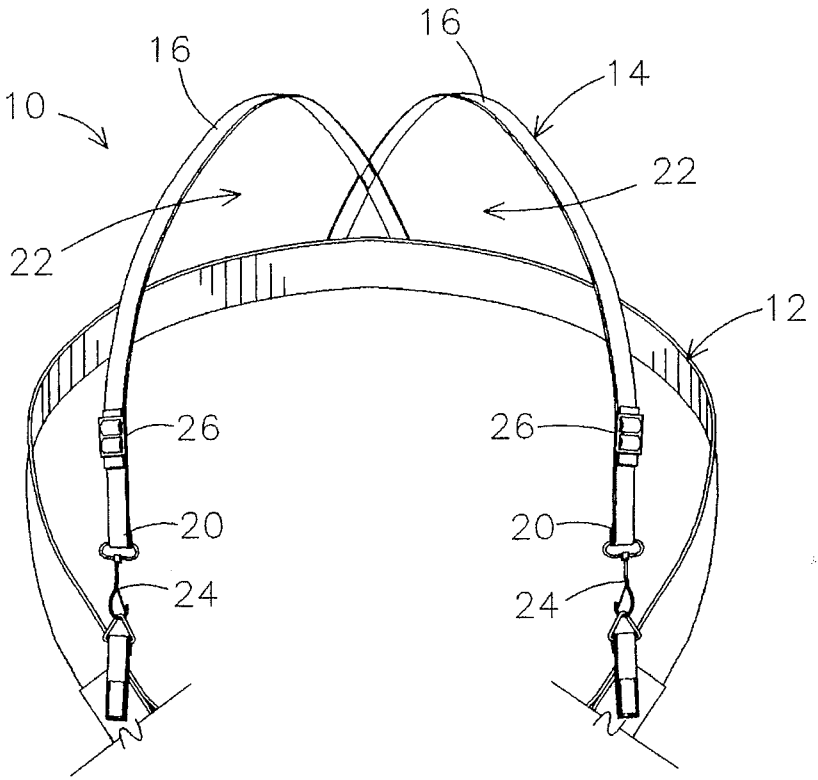
FIG. 2 is a perspective view of a portion of an alternate embodiment of the spine therapy and exercise device of the present invention.
Figure 1:
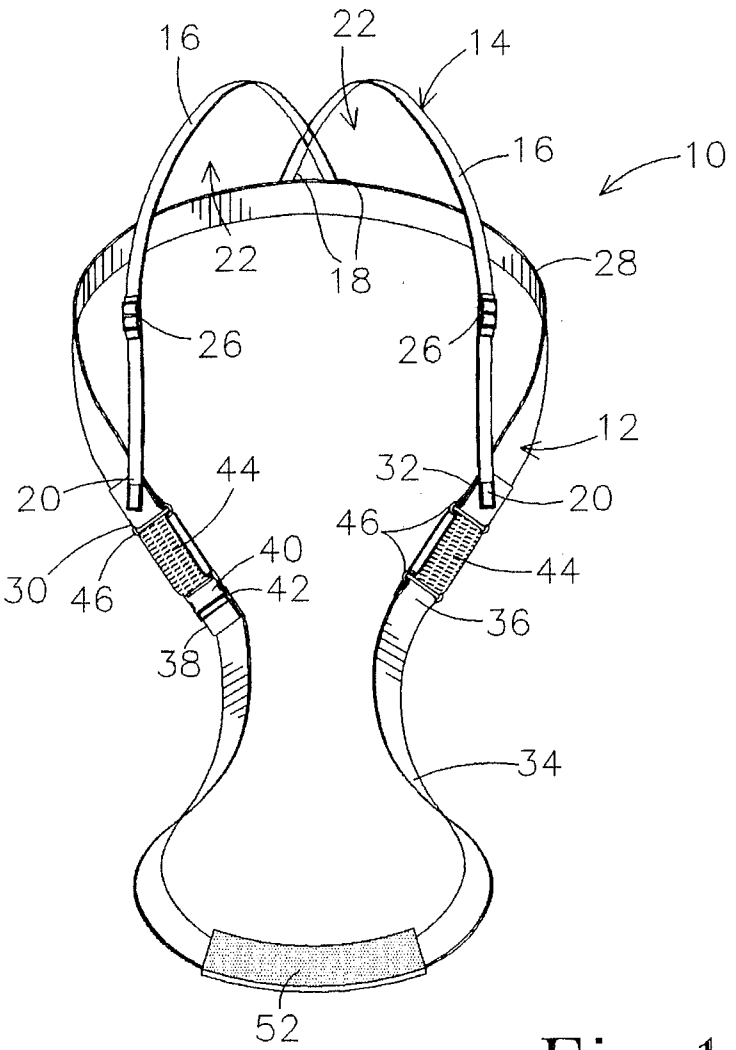
FIG. 1 is a perspective view of the spine therapy and exercise device constructed in accordance with several features of the present invention.

The device of the present invention is comprised generally of a belt member 12 and a harness 14. The harness 14 is carried by the belt member 12 and is provided for receiving the arms of the wearer. The harness 14 of the preferred embodiment is fabricated from a pair of straps 16. Each of the straps 16 is secured at a proximal end 18 to the belt member 12, cross each other to form an "X" configuration, and are then secured to the belt member 12 at their distal ends 20. Thus, a pair of loops 22 are formed for receiving the arms of the user such that the straps 16 are carried over the user's shoulders, the straps 16 cross on the user's back, and the belt circumvents the back and sides of the upper torso. The securement of the proximal ends 18 of the straps 16 to the belt member is of a conventional manner, such as by stitching. At the point at which they cross, the straps 16 are secured one to the other in a conventional manner such as by stitching. The securement of the distal ends 20 of the straps 16 to the belt member 12 is of a conventional fashion, as well. For ease of placing the device 10 on the wearer and removal therefrom, the distal ends 20 are removably secured to the belt member 12 in the preferred embodiment. As illustrated in FIG. 2, the distal ends 20 of the straps 16 are provided with a conventional clasp 24 for easily connecting and disconnecting the same to and from the belt member Adjustment members 26 are provided on each strap 16 for adjusting the size of the harness 14 to the particular wearer. Each adjustment member 26 is provided for varying the length of the particular strap 16. To this extent, although not shown in association with the straps 16, adjustment members 26 having a quick disconnect may be incorporated, thus obviating the clasps illustrated in FIG. 2. This type of adjustment member 26 is illustrated in FIG. 1 as an element of the belt member 12. For the individual straps 16, such an adjustment member 26 can be substituted for either of the adjustment members 26 illustrated in FIGS. 1 and 2. Any other conventional adjustment member 26 may be used as well, and it is therefore not intended that the present invention be limited to either of the adjustment members illustrated or otherwise disclosed.

The belt member 12 includes generally a torso engagement portion 28, and a leg engagement portion 34. The torso and leg engagement portions 28,34 are fabricated from a length of material such as nylon webbing and are connected in an end-to-end fashion such as to form a continuous loop. In order to aid in the use of the device 10, at least the proximal end 30 of the torso engagement portion 28 and the distal end 32 of the leg engagement portion 34 are releasably secured to each other using a connecting member 40 such as a conventional quick-disconnect member. In the preferred embodiment, an adjustment member 42 is also provided for varying the length of the loop for various sizes of users, for various types of exercises, and for various resistances during a given exercise. As illustrated, the adjustment member 42 of the preferred embodiment is integral with the connecting member 40. The distal end 38 of the leg engagement portion 34 is inserted through the adjustment member 42 such that it is a free end. Thus, it may be pulled to shorten the loop, or the leg engagement portion 34 may be oppositely pulled to lengthen the loop.

Figure 4:
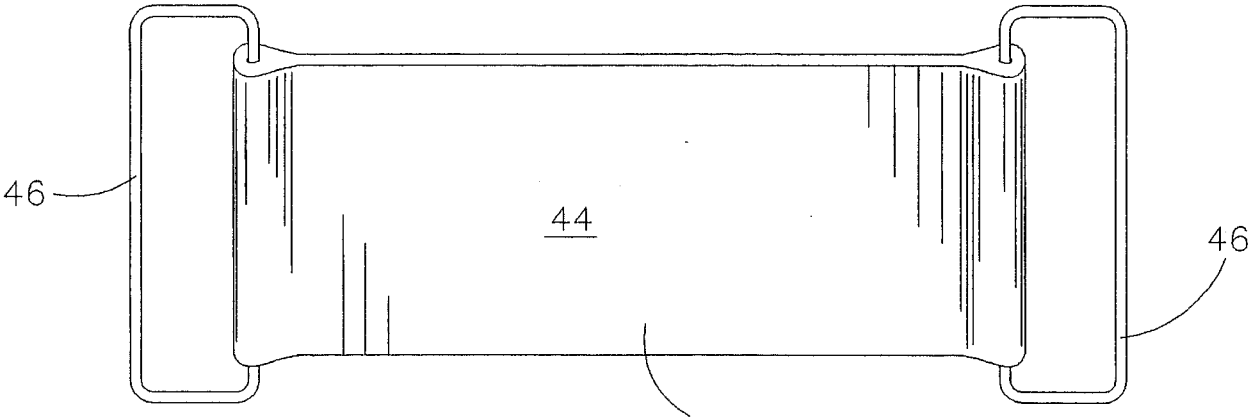
FIG. 4 is a perspective view of an elastomeric member incorporated in an alternate embodiment of the present invention.
Figure 3:
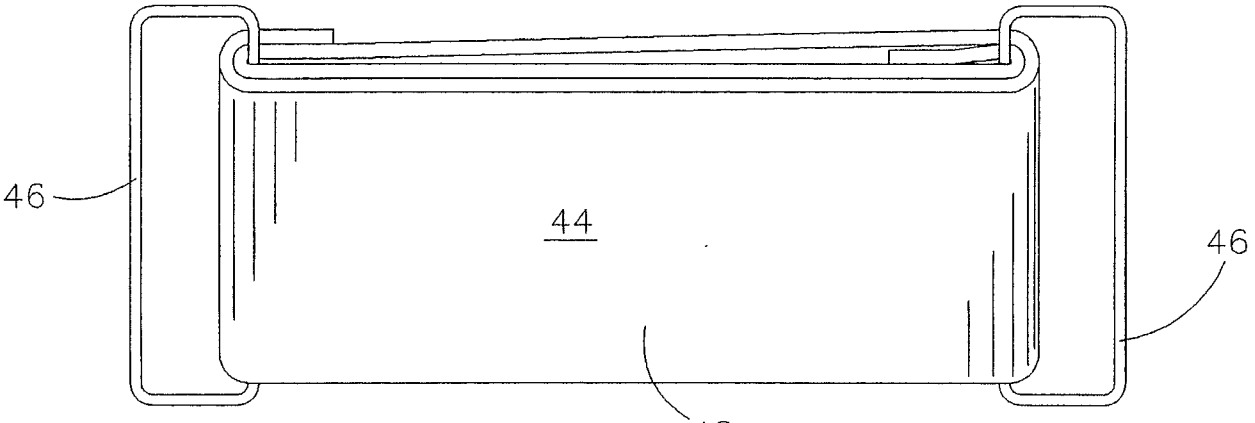
FIG. 3 is a perspective view of an elastomeric member incorporated in one embodiment of the present invention.

In order to allow for the active exercise and therapy of the back, an elastomeric member 44 is provided at each end 30,32 of the torso engagement portion 28. Thus, the leg engagement portion 34 is secured at its ends 36,38 to the elastomeric members 44 such that the elastomeric members 44 are placed between the torso and leg engagement portions 28,34 and whereby the loop configuration is maintained. Although not illustrated, in an embodiment wherein no elastomeric members 44 are incorporated, it will be understood that the torso and leg engagement portions 28,34 of the belt 12 may be integrally formed. As illustrated in FIG. 3, the elastomeric members 44 may be fabricated from an elastic material 48 secured in a loop configuration about two links 46. However, as illustrated in FIG. 4, an elastomeric material comprised of a rubber strap 50 having a link 46 secured at either end may be used as well. Other conventional elastomeric materials can be used, and other conventional configurations using those illustrated may be used. Therefore, it is not intended that the present invention be limited to the elastomeric materials and configurations illustrated or otherwise disclosed.

A cushion member 52 is carried by the leg engagement portion 34. In the preferred embodiment, the cushion member 52 is slidably received by the leg engagement portion 34 such that it may slide along the length thereof to adjust for various users and various exercises.

Figure 5:
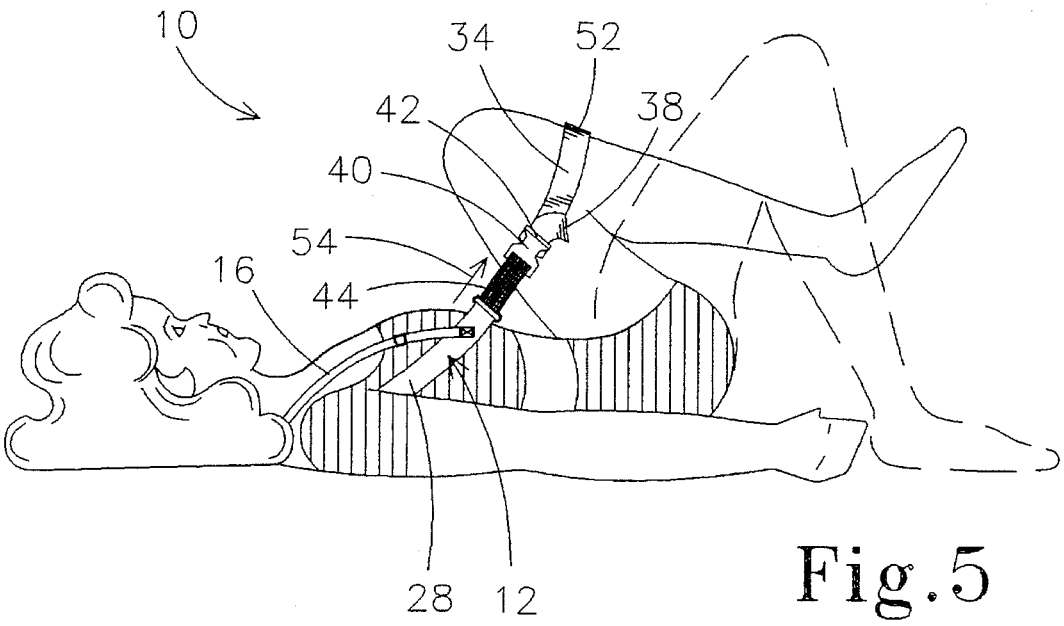
FIG. 5 illustrates a preferred exercise employing the spine therapy and exercise device of the present invention.
Figure 6:
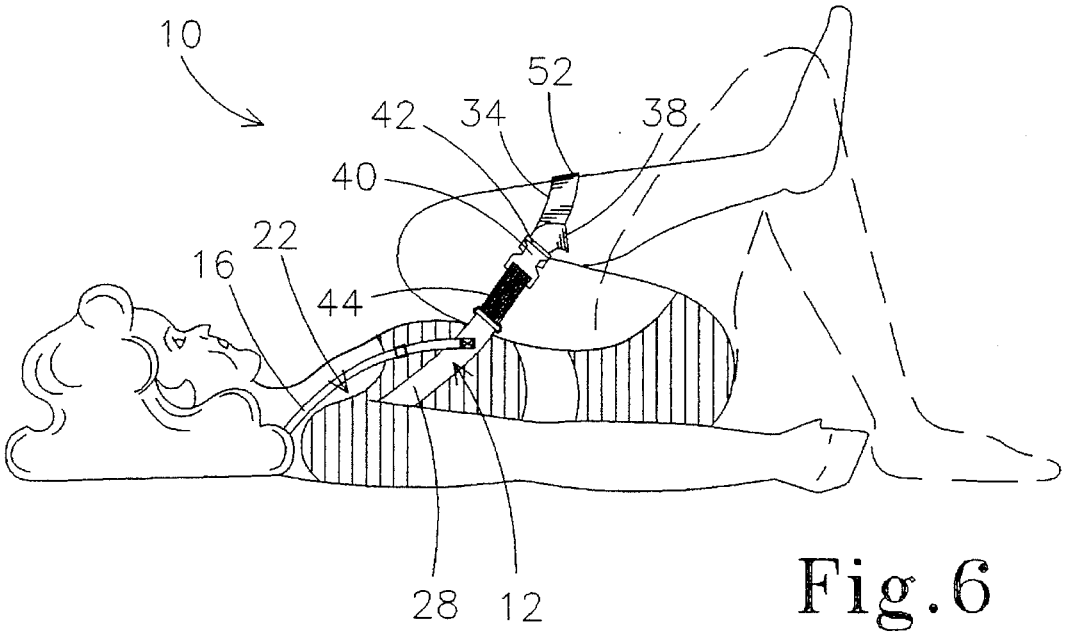
FIG. 6 illustrates another preferred exercise employing the spine therapy and exercise device of the present invention.

Illustrated in FIGS. 5–8 are two exemplary exercise routines which may be performed using the device 10 of the present invention. In each of these illustrations, the user is laying on her back. FIGS. 5 and 6 illustrate a stretching and strengthening exercise routine. The dashed lines illustrating the placement of the feet on the floor is indicative of a neutral spine position. The neutral spine position is the starting point for each of the exercises. This position is maintained for a period of time, and preferably, for at least one minute. As illustrated in FIG. 5, the second step in this particular routine is a resistance warmup. The knees are brought forward toward the chest and the leg engagement portion 34 is placed over the knees. The cushion member 52 is placed in engagement with the upper portion of the shin and the knees are then pushed slightly away from the chest as indicated by arrow 54. The resistance may be varied by using various elastomeric members 44 and by adjusting the length of the belt 12. Shortening the belt 12 by pulling the distal end 38 of the leg engagement portion 34 through the adjustment member 42 increases the resistance, and vice versa. After the resistance position has been maintained for two to four minutes, the user then returns to the neutral spine position for one to two minutes.

As illustrated in FIG. 6, the next step in the routine is to pull the knees toward the chest as far as possible and tighten the leg engagement portion 34 around the shins to obtain a comfortable resistance. This position is maintained for a period, for example, from two to ten minutes. During this period, the user relaxes and breathes normally. After this position has been maintained, isometric exercises are performed for approximately one minute. These exercises may include five to ten repetitions of pushing against the leg engagement portion 34 with the legs and holding for five to ten seconds.

Finally, the neutral spine position is resumed for at least two minutes. This routine, as described, requires a maximum of twenty minutes to perform However, it will be understood that the times disclosed for each portion of the routine are provided as exemplary information only, and the present invention is not intended to be limited to these times.

Figure 7:
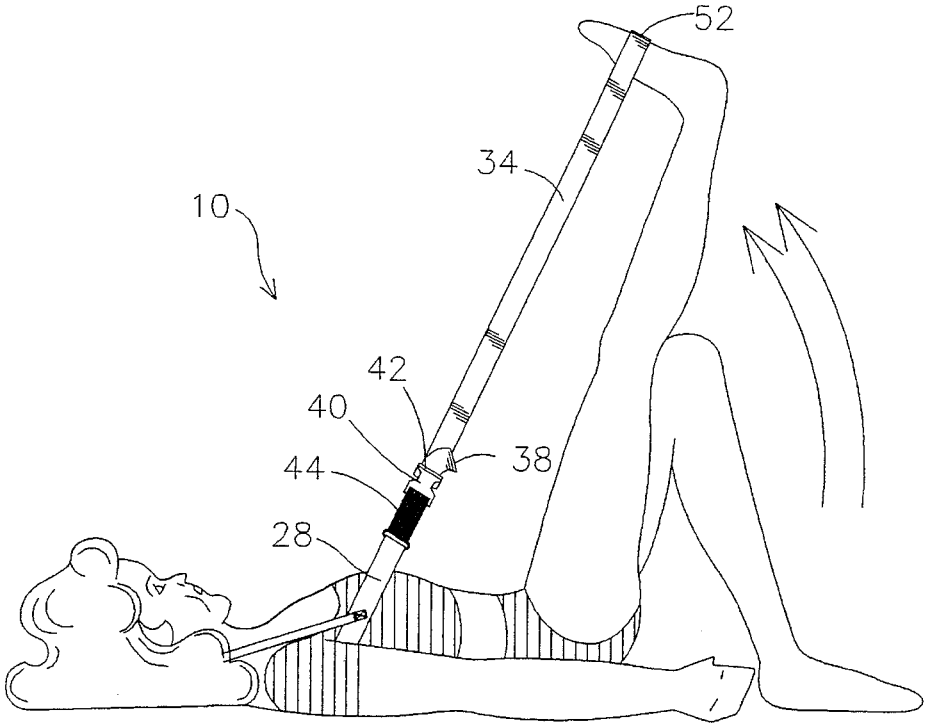
FIG. 7 illustrates another preferred exercise employing the spine therapy and exercise device of the present invention.
Figure 8:
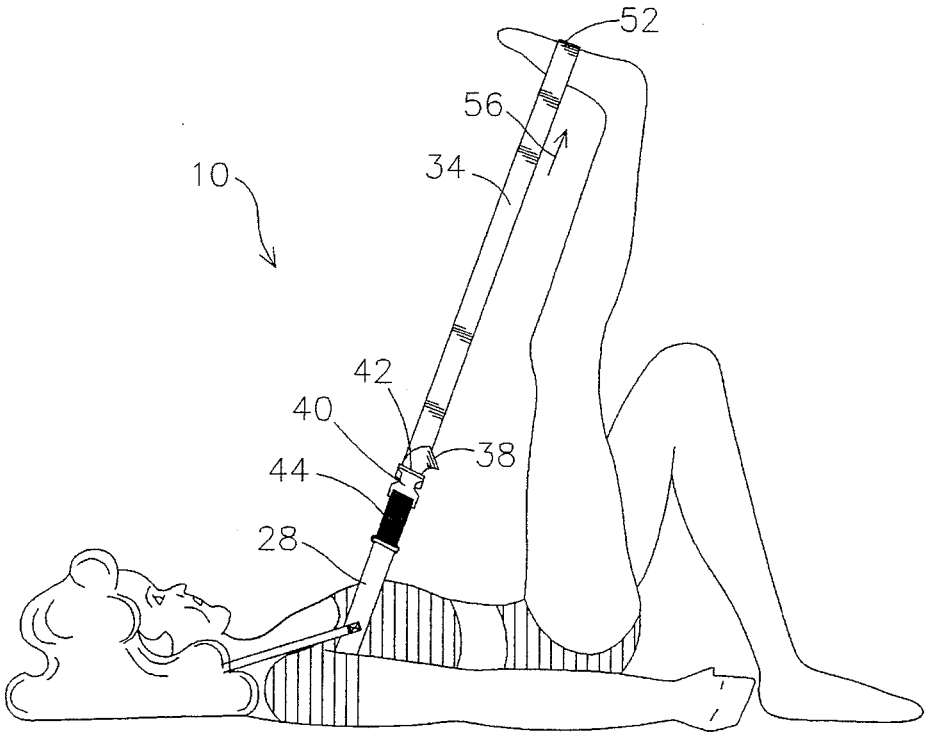
FIG. 8 illustrates another preferred exercise employing the spine therapy and exercise device of the present invention.

In another exercise routine as illustrated in FIGS. 7 and 8, the feet, as opposed to the shins are used to engage the leg engagement portion 34. As before, the neutral spine position is the starting position for this routine. The resistance position is held, as illustrated in FIG. 7, with one Foot engaging the cushion member 52 and the leg fully extended, the device 10 serving to pull the leg forward. The other foot remains on the floor as in the neutral spine position. After returning to the neutral spine position, the foot is then placed back into engagement with the cushion member 52 and the leg extended as illustrated in FIG. 8 by arrow 56. Resistance is added to the device by either pulling the distal end 38 of the leg engagement portion 34 to shorten the loop, or by pulling on the loop with the user's hands. In this step, the knee is bent and the leg is pulled forward, thus increasing the stretching of the hamstring and lower back muscles. Isometrics are performed, as before, by pressing out from the illustrated position for approximately five to ten seconds and for approximately five to ten repetitions. Finally, the neutral spine position is resumed. As illustrated, this routine is performed with one leg at a time. Therefore, it will need to be repeated using the other leg.

It will be understood that other exercises or exercise routines may be used as well as those described above. These are provided as exemplary exercises for stretching and strengthening the back and legs. By performing these and other exercises on a regular basis, many back disorders can be overcome or prevented altogether. Included are muscle guarding spasms, disc strain or bulge, postural strains and sprains, joint stiffness, and osteoarthritis. It is recommended that these exercises be performed consistently at a routine time. It has been found that by performing these exercises immediately after waking up, greater energy and flexibility is achieved throughout the day.

Use of the device 10 allows for improvement not only from back disorders, but also help one to relax, improves flexibility, strengthens back, abdominal, and leg muscles, improves posture, and increases general physical fitness. Specifically, the pelvic tilt position illustrated in FIG. 5 relieves pressure and strain on the lower back. Flexibility, which yields reduced strain on the spine, is acquired through the stretching exercise illustrated in FIG. 6. This exercise also increases lateral muscle balance, which increases the stabilization of the spine. This exercise further serves to help realign the spine. Strength is acquired through the isometric exercises described, with the various positions generating exercise to various muscles and muscle groups. By realigning the spine and strengthening the muscles associated therewith, the posture is accordingly improved.

From the foregoing description, it will be recognized by those skilled in the art that a spine therapy and exercise device offering advantages over the prior art has been provided. Specifically, the spine therapy and exercise device provides a means for passively and actively exercising the muscles associated with the spine, abdomen, and legs to improve flexibility and strength. Further, the device of the present invention provides a means for overcoming or preventing back disorders, and further assists in improving a person's posture.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A spine therapy and exercise device for stretching and strengthening muscles associated with one of at least a person's back, abdomen, and legs, said spine therapy and exercise device comprising:

a belt member defining a loop configuration, said belt member including a torso engagement portion and a leg engagement portion each being fabricated from a durable and flexible material, said torso and leg engagement portions each defining a proximal end and a distal end, said torso engagement portion being dimensioned to circumvent at least a person's back and sides, said leg engagement portion being secured to said torso engagement portion in an end-to-end fashion and being dimensioned to receive a portion of at least one of the person's legs;

a harness carried by said belt member, said harness torso engagement portion of said belt member proximate an upper portion of the user's back; and an adjustment member for varying a length of said loop configuration defined by said belt member, said adjustment member being secured to said proximal end of said torso engagement portion, said distal end of said leg engagement portion being slidably received by said adjustment member, said length of said loop configuration being adjusted by pulling said leg engagement portion through said adjustment member.

2. The spine therapy and exercise device of claim 1 wherein said proximal end of said torso engagement portion is releasably secured to said distal end of said leg engagement portion, said spine therapy and exercise device further comprising a connecting member for releasably securing said proximal end of said torso engagement portion to said distal end of said leg engagement portion.

3. The spine therapy and exercise device of claim 1 further comprising at least one elastomeric member defining first and second ends and connected in an end-to-end fashion to said torso and leg engagement portions to define said loop configuration.

4. The spine therapy and exercise device of claim 3 wherein first and second elastomeric members are provided, said first elastomeric member being secured in an end-to-end fashion between said proximal end of said torso engagement portion and said distal end of said leg engagement portion, said second elastomeric member being secured in an end-to-end fashion between said distal end of said torso engagement portion and said proximal end of said leg engagement portion.

5. The spine therapy and exercise device of claim 3 wherein said at least one elastomeric member is fabricated from an elastic fabric and a pair of links, said elastic fabric defining first and second ends, said first end being secured to one of said links, said second end being received through the other of said links and then through said one and said other of said links in alternating fashion a predetermined number of times, said distal end of said elastic fabric being secured to said elastic fabric.

6. The spine therapy and exercise device of claim 3 wherein said at least one elastomeric member includes an elastomeric strap and first and second links, said elastomeric strap defining first and second ends, said first link being secured to said first end of said elastomeric strap, and said second link being secured to said second end of said elastomeric strap.

7. The spine therapy and exercise device of claim 1 further comprising a cushion member slidably received by said leg engagement portion of said belt member.

8. The spine therapy and exercise device of claim 1 wherein said harness includes a pair of straps each defining proximal and distal ends, said proximal ends of said pair of straps each being secured to said torso engaging portion of said belt member, said pair of straps crossing to form a substantially "X"-shaped configuration, said straps being secured one to another at a point of crossing, said distal ends of said pair of straps being secured to said torso engaging portion of said belt member.

9. The spine therapy and exercise device of claim 8 wherein each of said pair of straps is provided with an adjustment member for adjusting a length thereof.

10. The spine therapy and exercise device of claim 8 wherein said distal ends of each of said pair of straps is releasably connected to said torso engaging portion of said belt member, each of said pair of straps being provided with a conventional releasable fastener.

11. A spine therapy and exercise device for stretching and strengthening muscles associated with one of at least a person's back, abdomen, and legs, said spine therapy and exercise device comprising:

a belt member defining a loop configuration, said belt member including a torso engagement portion and a leg engagement portion each being fabricated from a durable and flexible material, said torso and leg engagement portions each defining a proximal end and a distal end, said torso engagement portion being dimensioned to circumvent at least a person's back and sides, said leg engagement portion being secured to said torso engagement portion in an end-to-end fashion and being dimensioned to receive a portion of at least one of the person's legs;

a connecting member for releasably securing said proximal end of said torso engagement portion to said distal end of said leg engagement portion;

an adjustment member carried by said connecting member for varying a length of said loop configuration defined by said belt member, said distal end of said leg engagement portion being slidably received by said adjustment member, said length of said loop configuration being adjusted by pulling said leg engagement portion through said adjustment member; and a harness carried by said belt member, said harness being provided for positioning said torso engagement portion of said belt member proximate an upper portion of the user's back, said harness including a pair of straps each defining proximal and distal ends, said proximal ends of said pair of straps each being secured to said torso engaging portion of said belt member, said pair of straps crossing to form a substantially "X"-shaped configuration, said straps being secured one to another at a point of crossing, said distal ends of said pair of straps being secured to said torso engaging portion of said belt member, each of said pair of straps being provided with an adjustment member for adjusting a length thereof.

12. The spine therapy and exercise device of claim 11 further comprising first and second elastomeric members, said first elastomeric member being secured in an end-to-end fashion between said proximal end of said torso engagement portion and said connecting member, said second elastomeric member being secured in an end-to-end fashion between said distal end of said torso engagement portion and said proximal end of said leg engagement portion.

13. The spine therapy and exercise device of claim 12 wherein said first and second elastomeric members are fabricated from an elastic fabric and a pair of links, said elastic fabric defining first and second ends, said first end being secured to one of said links, said second end being received through the other of said links and then through said one and said other of said links in alternating fashion a predetermined number of times, said distal end of said elastic fabric being secured to said elastic fabric.

14. The spine therapy and exercise device of claim 12 wherein said first and second elastomeric members include an elastomeric strap and first and second links, said elastomeric strap defining first and second ends, said first link being secured to said first end of said elastomeric strap, and said second link being secured to said second end of said elastomeric strap.

15. The spine therapy and exercise device of claim 11 further comprising a cushion member slidably received by said leg engagement portion of said belt member.

16. The spine therapy and exercise device of claim 11 wherein said distal ends of each of said pair of straps is releasably connected to said torso engaging portion of said belt member, each of said pair of straps being provided with a conventional releasable fastener.

17. A spine therapy and exercise device for stretching and strengthening muscles associated with one of at least a person's back, abdomen, and legs, said spine therapy and exercise device comprising:

a belt member defining a loop configuration, said belt member including a torso engagement portion and a leg engagement portion each being fabricated from a durable and flexible material, said torso and leg engagement portions each defining a proximal end and a distal end, said torso engagement portion being dimensioned to circumvent at least a person's back and sides, said leg engagement portion being secured to said torso engagement portion in an end-to-end fashion and being dimensioned to receive a portion of at least one of the person's legs;

a connecting member for releasably securing said proximal end of said torso engagement portion to said distal end of said leg engagement portion;

an adjustment member carried by said connecting member for varying a length of said loop configuration defined by said belt member, said distal end of said leg engagement portion being slidably received by said adjustment member, said length of said loop configuration being adjusted by pulling said leg engagement portion through said adjustment member;

first and second elastomeric members, said first elastomeric member being secured in an end-to-end fashion between said proximal end of said torso engagement portion and said connecting member, said second elastomeric member being secured in an end-to-end fashion between said distal end of said torso engagement portion and said proximal end of said leg engagement portion;

a harness carried by said belt member, said harness being provided for positioning said torso engagement portion of said belt member proximate an upper portion of the user's back, said harness including a pair of straps each defining proximal and distal ends, said proximal ends of said pair of straps each being secured to said torso engaging portion of said belt member, said pair of straps crossing to form a substantially "X"-shaped configuration, said straps being secured one to another at a point of crossing, said distal ends of said pair of straps being releasably secured to said torso engaging portion of said belt member, each of said pair of straps being provided with an adjustment member for adjusting a length thereof, each of said pair of straps being provided with a conventional releasable fastener; and a cushion member slidably received by said leg engagement portion of said belt member.

18. The spine therapy and exercise device of claim 17 wherein said first and second elastomeric members are fabricated from an elastic fabric and a pair of links, said elastic fabric defining first and second ends, said first end being secured to one of said links, said second end being received through the other of said links and then through said one and said other of said links in alternating fashion a predetermined number of times, said distal end of said elastic fabric being secured to said elastic fabric.

19. The spine therapy and exercise device of claim 17 wherein said first and second elastomeric members include an elastomeric strap and first and second links, said elastomeric strap defining first and second ends, said first link being secured to said first end of said elastomeric strap, and said second link being secured to said second end of said elastomeric strap.

* * * * *